US005087138A

United States Patent [19]

Terbrusch et al.

[11] Patent Number: 5,087,138

[45] Date of Patent: Feb. 11, 1992

[54] SUNTAN OIL APPLICATOR

[76] Inventors: Rosemarie Terbrusch, RD 4 Blueberry Ln., South Salem, N.Y. 10590; George Spector, 233 Broadway #3815, New York City, N.Y. 10007

[21] Appl. No.: 431,433

[22] Filed: Nov. 2, 1989

[51] Int. Cl.[5] ..... A45D 34/00

[52] U.S. Cl. ..... 401/206; 401/6; 401/140; 401/276

[58] Field of Search ..... 401/6, 140, 206, 207, 401/263, 276

[56] References Cited

U.S. PATENT DOCUMENTS

| | | | |
|---|---|---|---|
| 1,191,604 | 7/1916 | McCurdy | 401/276 |
| 2,180,506 | 11/1939 | Burbig | 401/206 X |
| 2,261,411 | 11/1941 | Rees | 401/207 |
| 2,979,757 | 4/1961 | Smith | 401/206 |
| 3,056,997 | 10/1962 | Cummings | 401/276 X |
| 4,008,968 | 2/1977 | Hobbs | 401/140 |
| 4,078,865 | 3/1978 | Moser | 401/140 X |
| 4,171,171 | 10/1979 | Jones | 401/6 X |

FOREIGN PATENT DOCUMENTS

| | | | |
|---|---|---|---|
| 92934 | 4/1922 | Switzerland | 401/263 |
| 2119235 | 11/1983 | United Kingdom | 401/207 |
| 2160092 | 12/1985 | United Kingdom | 401/140 |

*Primary Examiner*—Steven A. Bratlie

[57] ABSTRACT

A suntan lotion applicator is provided and consists of an elongated hollow handle connected to a flat head over a central aperture and a pad affixed to underside of the head for applying the suntan lotion on the skin. A removable cover is on the head for isolating the pad when not in use and a cap is detachably connected to the handle to protect the suntan lotion within the handle.

1 Claim, 1 Drawing Sheet

SUNTAN OIL APPLICATOR

BACKGROUND OF THE INVENTION

The instant invention relates generally to fluid dispensers and more specifically it relates to a suntan lotion applicator.

There are available conventional fluid dispensers of various designs but which do not provide the novel improved functions and structure of the invention herein disclosed.

SUMMARY OF THE INVENTION

A primary object of the present invention is to provide a suntan lotion applicator that will overcome the shortcomings of the prior art devices.

Another object is to provide a suntan lotion applicator which will allow a person to apply the suntan lotion to the skin while keeping the hands dry.

An additional object is to provide a suntan lotion applicator that is structured to apply the suntan lotion to hard to reach areas of the skin, such as the back, so that a person can receive an even tan from the rays of the sun.

A further object is to provide a suntan lotion applicator that is simple and easy to use.

A still further object is to provide a suntan lotion applicator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
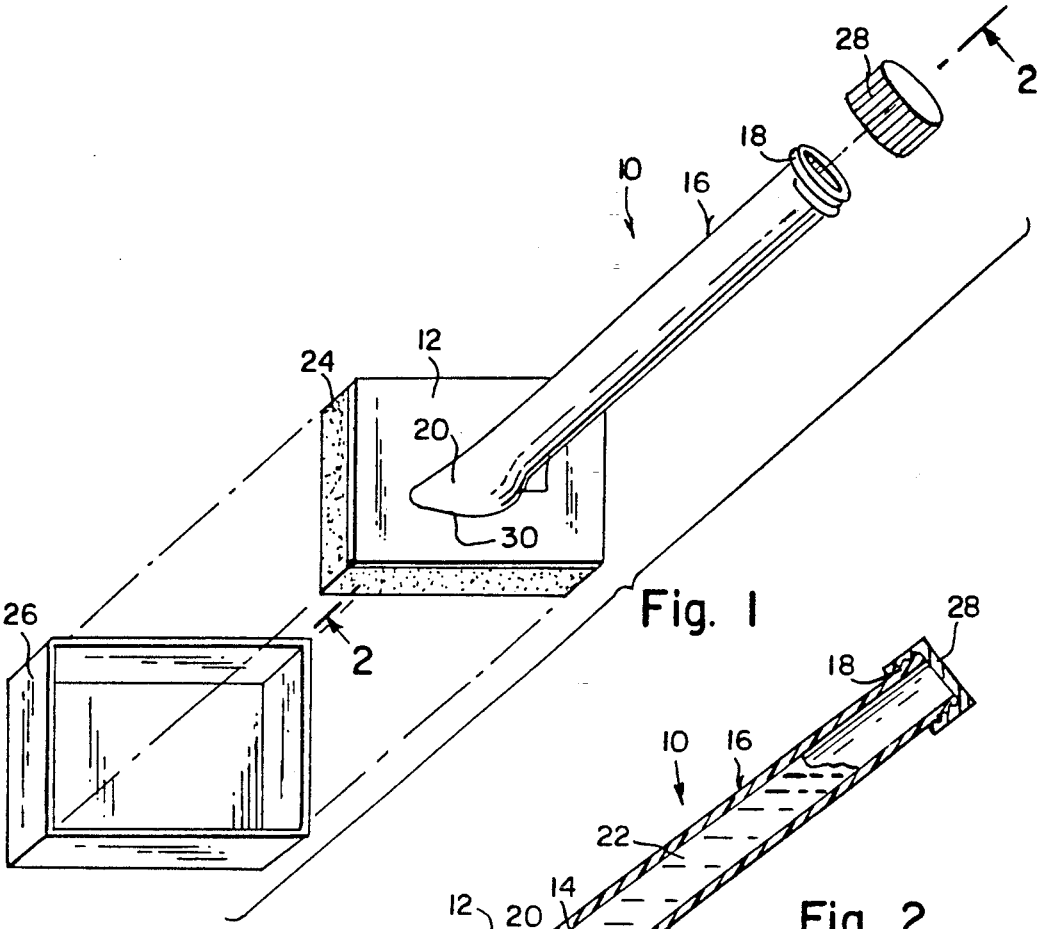
FIG. 1 is an exploded perspective view of the invention comprising a lotion applicator and cover.
Figure 2:
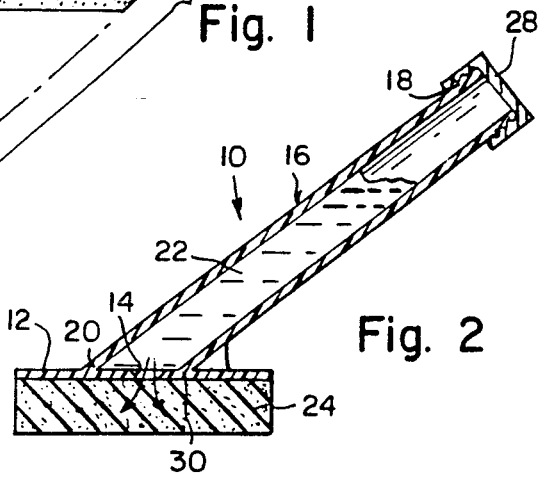
FIG. 2 is a cross sectional view of the applicator per se taken along line 2—2 in FIG. 1.

Turning now descriptively to the drawings, in which similar reference characters denote similar elements throughout the several views, FIGS. 1 and 2 illustrate a suntan lotion applicator 10 consisting of a flat head 12 having a central aperture 14 therein. An elongated hollow handle 16 has a proximate end 18 and a distal end 20. The distal end is connected to the head 12 over the central aperture 14 while the proximate end 18 has an open entry for addition of suntan lotion 22 into the handle 16 and through the central aperture 14 in the head 12. A resilient absorbent pad 24 is affixed to underside of the head 12 and presents a surface area for rubbing the suntan lotion 22 on the skin of a person. A removable cover 26 is also provided on the head 12 for isolating the pad 24 during periods of non-use. A cap 28 is detachably connected to the proximate end 18 of the handle 16 so as to protect the suntan lotion 22 disposed within the handle 16.

The distal end 20 of the handle 16 is angularly cut at 30 and is connected to the head 12 over the central aperture 14 at a preferred angle so that application of the suntan lotion 22 can be properly applied to the skin of a person.

Figure 3:
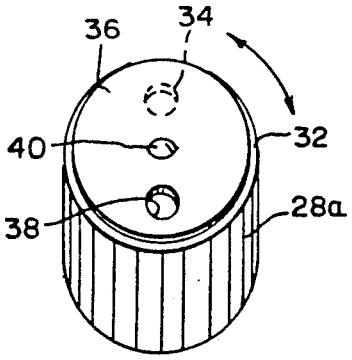
FIG. 3 is a top perspective view of a modified cap showing a rotary disc having a hole which can line up with a hole in the cap for allowing the lotion to freely run into the pad.

FIG. 3 shows a modified cap 28*a* that includes a top portion 32 having an off center aperture 34 therethrough. A disc 36 having an off center hole 38 is carried on the top portion 32. A pivot pin 40 extends through center of the disc 36 and the top portion 32. The disc 36 can be rotated in which the hole 38 in the disc can line up with the aperture 34 in the top portion 32 allowing the suntan lotion 22 to freely run into the pad 24.

Figure 4:
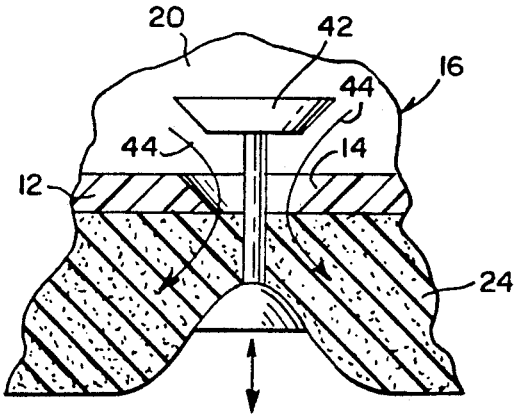
FIG. 4 is an enlarged cross sectional view showing a lotion release valve operable by compressing the pad.

As shown in FIG. 4, the applicator 10 can further include a suntan lotion release valve 42 carried between center of the pad 24 and into the central aperture 14 in the head 12. By manually compressing the pad 24 the valve 42 will open allowing the suntan lotion 22 to enter into the pad as indicated by arrows 44.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A suntan lotion applicator comprising;

a) a flat head having a central aperture therein;

b) an elongated hollow handle having a proximate end and a distal end, the distal end connected to said head over the central aperture while the proximate end having an open entry for addition of suntan lotion into said handle and through the central aperture in said head;

c) a resilient absorbent pad affixed to underside of said head and presenting a surface area for rubbing the suntan lotion on the skin of a person;

d) a removable cover on said head for isolating said pad during periods of non-use;

e) a cap detachably connected to the proximate end of said handle so as to protect the suntan lotion disposed within said handle; wherein the distal end of said handle is angularly cut and is connected to said head over the central aperture at a preferred angle so that application of the suntan lotion can be properly applied to the skin of a person, wherein said cap further includes:

f) a top portion having an off center aperture therethrough;

g) a disc having an off center hole therethrough whereby said disc is carried on said top portion;

h) a pivot pin extending through center of said disc and said top portion so that said disc can be rotated in which the hole in said disc can line up with the aperture in said top portion allowing the suntan lotion to freely run into said pad; further including a suntan lotion release valve assembly mounted on said pad having a head external to said pad engaging the center of said pad and a stem extending through said pad and said head aperture including a valve at an inner end of said stem in combination with a seat surrounding said head aperture coacting with said valve, wherein external pressure on said head causes pad compression and inward opening movement of said valve.

* * * * *